US006695436B2

(12) United States Patent
Jang et al.

(10) Patent No.: US 6,695,436 B2
(45) Date of Patent: Feb. 24, 2004

(54) APPARATUS TO REMOVE INK CARTRIDGE OF INK-JET PRINTER

(75) Inventors: Deok-hwan Jang, Suwon (KR); Yong-hyun Lee, Suwon (KR); Heon-soo Park, Sungnam (KR); Chang-soo Byun, Gumi (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/137,419

(22) Filed: May 3, 2002

(65) Prior Publication Data

US 2002/0163566 A1 Nov. 7, 2002

(30) Foreign Application Priority Data

May 3, 2001 (KR) ..... 2001-24163

(51) Int. Cl.[7] ..... B41J 2/01
(52) U.S. Cl. ..... 347/49; 347/37
(58) Field of Search ..... 347/37, 38, 39, 347/49

(56) References Cited

U.S. PATENT DOCUMENTS 5,629,725 A * 5/1997 Buican ..... 347/49
5,696,541 A * 12/1997 Akahane et al. ..... 347/8
6,059,396 A * 5/2000 Choi ..... 347/37
6,065,826 A * 5/2000 Robinson et al. ..... 347/49
6,502,917 B1 * 1/2003 Shinada et al. ..... 347/19

* cited by examiner

*Primary Examiner*—Anh T. N. Vo
(74) *Attorney, Agent, or Firm*—Staas & Halsey LLP

(57) ABSTRACT

An apparatus to remove an ink cartridge of an ink-jet printer. The apparatus includes a carriage having a supporting frame movably supported by a guide rail, and a receptacle connected to the supporting frame, an ink cartridge removable from the receptacle, the ink cartridge having a latching protrusion formed at an upper end thereof, a latching unit disposed at the supporting frame, being compressible and de-compressible to an original form, the latching unit in a compressed state latching the latching protrusion of the ink cartridge and the latching unit in a de-compressed state, is released from the latching protrusion, and a moving unit having a joint portion which pivots at a predetermined angle. The moving unit is pivotally disposed at the supporting frame, the moving unit to pivot in a first direction to completely mount the ink cartridge from a temporary mounting position in the receptacle and to compress the latching unit. The jointing portion is fixedly positioned in a bent state due to a recovery force of the compressed latching unit, and the moving unit pivots in a second direction, opposite to the first direction to permit the latching unit to return to the uncompressed state.

23 Claims, 6 Drawing Sheets

APPARATUS TO REMOVE INK CARTRIDGE OF INK-JET PRINTER

CROSS-REFERENCE TO RELATED APPLICATIONS

This application claims the benefit of Korean Application No. 2001-24163, filed May 3, 2001, in the Korean Industrial Property Office, the disclosure of which is incorporated herein by reference.

BACKGROUND OF THE INVENTION

1. Field of the Invention

The present invention relates to an ink-jet printer, and more particularly, to an apparatus to remove an ink cartridge from the ink-jet printer.

2. Description of the Related Art

As shown in FIG. 1, an ink-jet printer generally comprises a carriage 20 for carrying an ink cartridge 10 mounted thereon along a predetermined guide rail (not illustrated). The ink cartridge 10 has an ink vessel 11 for storing ink, an ink cartridge head 13 for controlling an ink nozzle (not shown) disposed at a lower side of the ink vessel 11, and a latch lid 15 for mounting the ink cartridge 10 to the carriage 20.

The carriage 20 comprises a supporting frame 21 mounted to a main frame (not illustrated) and moved along the guide rail, a receptacle 22 disposed at the supporting frame 21 for serving as a sub-guide when the ink cartridge 10 is mounted, and latching means for securing the ink cartridge 10 to the receptacle 22 by latching the receptacle 22 to the latch lid 15. The latching means comprises a spring 23, and a latch 24 disposed at one side of the supporting frame 21 and corresponding to the latch lid 15, which is elastically pressed by the spring 23. Also, a Flexible Printed Circuit (FPC) 25 and an elastic element 26 are provided between the supporting frame 21 and the receptacle 22. The FPC 25 supplies power to the ink cartridge head 13 and the elastic element 26 for increasing a contact force between a dimple 25*a* provided on the FPC 25 and the ink cartridge head 13.

In order to mount the ink cartridge 10 to the carriage 20, the ink cartridge 10 is inserted into the receptacle 22. Next, an upper end of the ink cartridge 10 is forcibly pushed toward the carriage 20. Then, as shown in FIG. 2, a sloping surface of the latch lid 15 raises the latch 24 while sliding over a sloping surface of the latch 24. At the same time, the latch lid 15 moves forward in the direction indicated by the arrow labeled "A". If the latch lid 15 is completely moved in the "A" direction, the ink cartridge 10 is in close contact with one sidewall of the receptacle 22, and also the latch 24 descends due to a recovery force of the spring 23, thereby preventing the latch lid 15 from moving in the direction indicated by the arrow labeled "B".

The ink cartridge 10 is removed from the carriage 20 in reverse order to the order by which the ink cartridge 10 is mounted to the carriage 20. That is, the upper end of the ink cartridge 10 is pulled forcibly in the "B" direction, and thus the latch lid 15 is removed from the one sidewall of the receptacle 22 while lifting up the latch 24, so that the ink cartridge 10 is removed from the carriage 20.

However, when the ink cartridge 10 is mounted in the way as described above, the spring 23 must have a predetermined force for increasing the contact force between the dimple 25*a* and the ink cartridge head 13. Accordingly, it is difficult for a user to overcome the force of the spring 23 and replace the ink cartridge 10. Also, it is not clear how to handle the ink cartridge 10 during mounting and removal. Thus, when an unskilled user handles the ink cartridge 10, there may be damage to the ink cartridge head 13 or the dimple 25*a*.

Furthermore, in order to remove the ink cartridge 10 from the carriage 20, the user needs sufficient space to hold the ink cartridge 10 and pull out the ink cartridge 10. However, this space may be so small that the user must use his/her fingertips or fingernails. Thus, fingernails may be broken, injured, or may contact components of the ink cartridge 10, thereby causing damage.

Furthermore, it is difficult for the user to ascertain with the naked eye whether the ink cartridge 10 is mounted accurately. Thus, the ink cartridge 10 might be mounted inaccurately, unbeknownst to the user. If the ink cartridge 10 is mounted inaccurately, the contact force between the dimple 25*a* and the ink cartridge head 13 becomes weak, and thus the ink nozzle cannot be properly controlled and printing quality deteriorates.

SUMMARY OF THE INVENTION

Accordingly, it is an object of the present invention is to provide an apparatus to remove an ink cartridge of an ink-jet printer in which the ink cartridge is mounted and removed with little effort from a user.

Additional objects and advantages of the invention will be set forth in part in the description which follows and, in part, will be obvious from the description, or may be learned by practice of the invention.

The foregoing and other objects of the present invention are achieved by providing an apparatus to remove an ink cartridge of an ink-jet printer, the apparatus includes a carriage having a supporting frame movably supported by a guide rail, and a receptacle connected to the supporting frame, an ink cartridge removable from the receptacle, the ink cartridge having a latching protrusion formed at an upper end thereof, a latching unit disposed at the supporting frame, being compressible and de-compressible. In a compressed state, the latching unit latches the latching protrusion of the ink cartridge mounted in the receptacle, and in a de-compressed state, the latching unit is released from the latching protrusion. The apparatus further includes a moving unit having a joint portion to pivot at a predetermined angle, the moving unit pivotally disposed at the supporting frame, to pivot in a first direction to mount the ink cartridge from a temporary mounting position in the receptacle and to compress the latching unit. The joint portion is fixedly positioned in a bent state due to a recovery force of the compressed latching unit, the moving unit to pivot in a second direction, opposite to the first direction, to permit the latching unit to recover its original form.

The latching unit includes a spring, a latch member connected to a first end of the spring, the latch member having a sloping side corresponding to the latching protrusion, and a contact member connected to a second end of the spring, opposite to the first end of the spring, the contact member having a guide recess formed at an upper end thereof to guide the contact member to contact the moving unit.

Also, the moving unit includes a moving lever, a first end of which is pivotally disposed at the supporting frame, the moving lever to pivot downward to compress the latching unit, a handle lever disposed at a second end, opposite the first end of the moving lever, and to pivot at a predetermined angle, the handle lever first pivoting on the moving lever and then pivoting together with the moving lever. The moving unit further includes a lever spring disposed at a lower end of the handle lever, the lever spring pressing an upper portion of the ink cartridge from the temporary mounting position in the receptacle to contact the supporting frame during the pivoting movement of the handle lever.

At least one of respective hinge connecting portions of the moving lever and the handle lever defines a jaw to restrict an angle of relative pivotal movement of the moving lever and the handle lever. The lever spring is a plate spring made of a metallic material or is made of an engineering plastic material or is a coil spring. The apparatus further includes a position protrusion formed at the moving unit to contact the latching unit during the pivoting of the moving unit, the position protrusion being disposed farther away from the supporting frame than a hinge point on the supporting frame of the moving unit.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
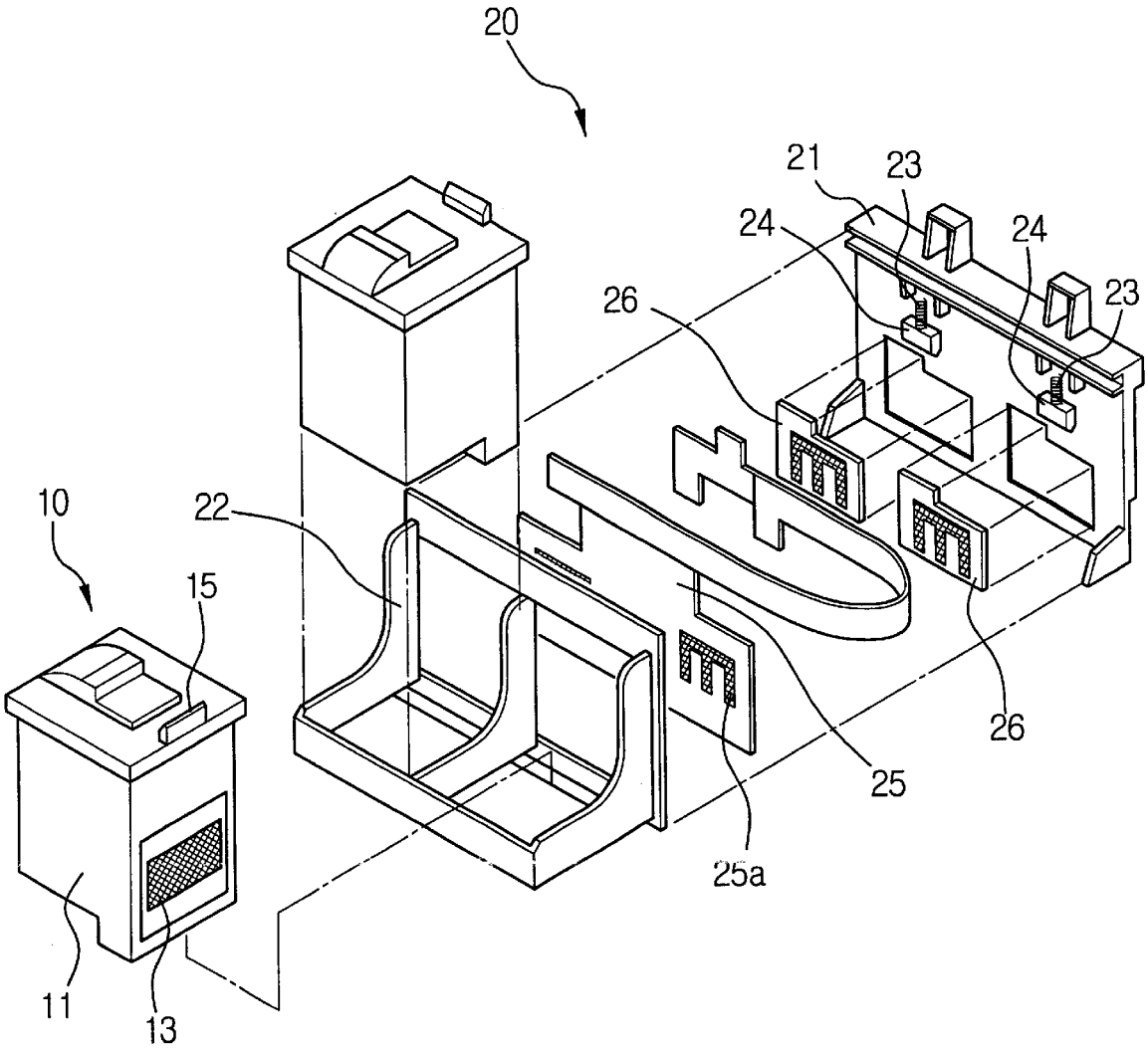
FIG. 1 (PRIOR ART)
FIG. 1 is an exploded perspective view schematically showing a carriage and ink cartridge of a conventional ink-jet printer.

Reference will now be made in detail to the present preferred embodiments of the present invention, examples of which are illustrated in the accompanying drawings, wherein like reference numerals refer to like elements throughout.

Figure 3:
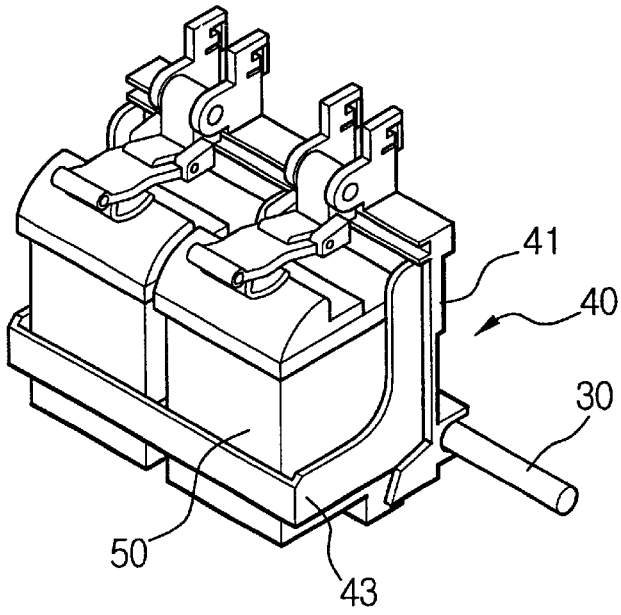
FIG. 3 is a schematic perspective view showing an apparatus to remove an ink cartridge of an ink-jet printer according to an embodiment of the present invention.
Figure 4:
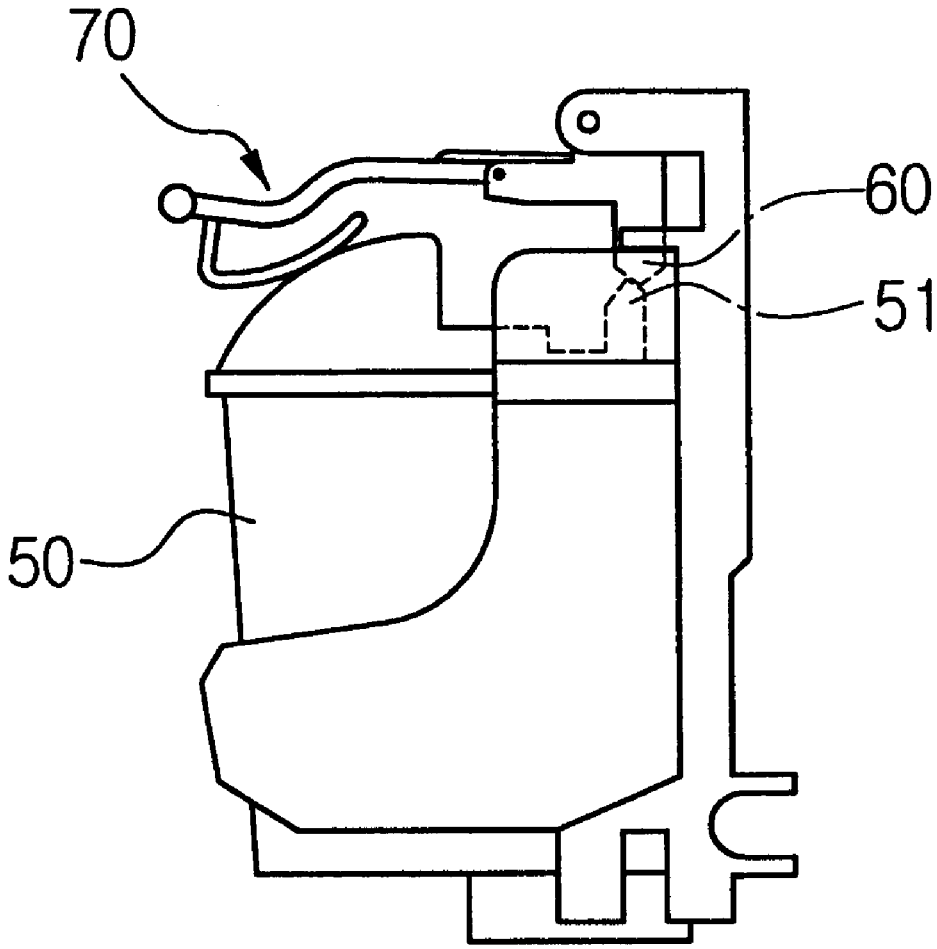
FIG. 4 is a side view showing the apparatus to remove an ink cartridge of FIG. 3.

As shown in FIGS. 3 and 4, according to an embodiment of the present invention, an apparatus to remove an ink cartridge of an ink-jet printer includes a carriage 40 capable of moving along a guide rail 30, an ink cartridge 50 removably connected to the carriage 40, a latching unit 60, and a moving unit 70.

The carriage 40 includes a supporting frame 41 which is supported by and slides along the guide rail 30, and a receptacle 43 connected to the supporting frame 41 to contain and support the ink cartridge 50. The receptacle 43 defines a space sufficient to move the ink cartridge 50 without restriction.

Figure 2:
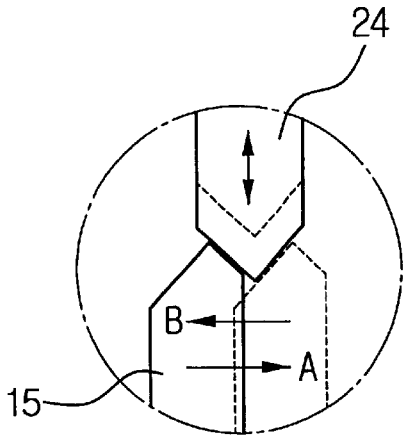
FIG.2 (PRIOR ART)
FIG. 2 is a schematic view showing the interaction between the ink cartridge and the carriage of FIG. 1.

The ink cartridge 50 has a latching protrusion 51 formed at an upper end thereof. The latching protrusion 51 has a guide cap 67 to contact a latch member 63, which will be described later. Since the ink cartridge 50 and various parts disposed between the ink cartridge 50 and the carriage 40 have been described in detail with reference to FIGS. 1 and 2, the descriptions thereof will be omitted.

Figure 5A:
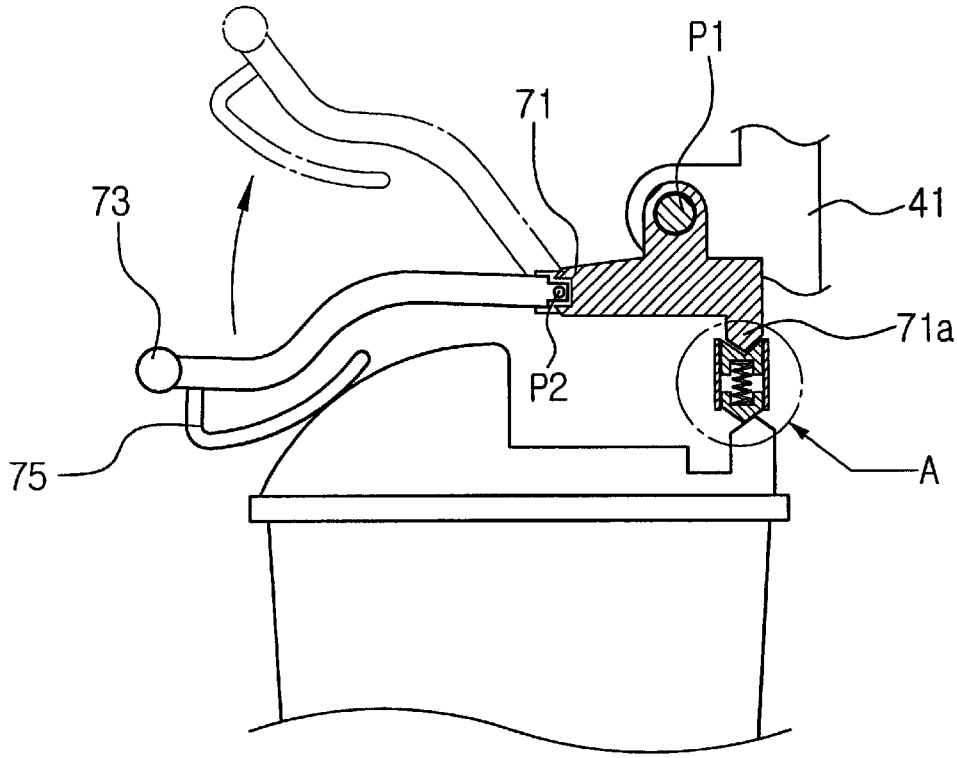
FIG. 5A is a schematic sectional view showing parts of FIG. 3.
Figure 5B:
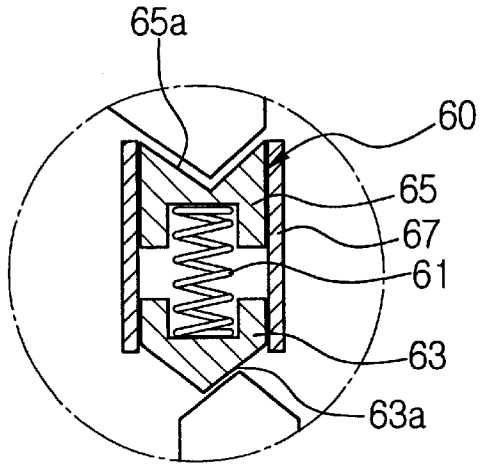
FIG. 5B is a sectional view showing a portion of FIG. 5A in detail.

As shown in FIGS. 5A and 5B, the latching unit 60 is disposed at the supporting frame 41 to be compressed downward and de-compressed upward. If the latching unit 60 is compressed to give pressure to the latching protrusion 51, the latching protrusion 51 is latched to an immovable state. If the latching unit 60 is elastically de-compressed, the latching protrusion 51 is released from the latched state such that the latching protrusion 51 can be moved by an external force. The latching unit 60 comprises a spring 61, a latch member 63 connected to a lower end of the spring 61 and a contact member 65 connected to an upper end of the spring 61. The latch member 63 has reverse mountain-shape sloping surfaces 63*a* to correspond to the latching protrusion 51. Accordingly, if the ink cartridge 50 is moved when the latching protrusion 51 and the latch member 63 are in contact with each other, the latching protrusion 51 raises the latch member 63 while moving.

Also, the contact member 65 has a valley-shaped guide recess 65*a* formed at an upper end thereof, to guide the contact member 65 to contact a lower end of a moving lever 71 (described later) when the moving lever 71 pivots. Accordingly, the contact member 65 maintains secure contact with the moving lever 71 when the moving lever 71 pivots such that the contact member 65 is able to compress the spring 61, without being twisted or deviated by the pressure of the moving lever 71. The latching unit 60 is guided and prevented from being removed by a guide cap 67 disposed at the supporting frame 41.

The moving unit 70 has one joint portion formed at a center portion thereof that pivots at a predetermined angle. The moving unit 70 comprises the moving lever 71, one end of which is pivotally disposed at the supporting frame 41, a handle lever 73 pivotally disposed at an opposite end of the moving lever 71 from the supporting frame, and a lever spring 75 disposed at a lower side of the handle lever 73. The moving lever 71 is attached to the handle lever 73 by the joint portion. The moving unit 70 also pivots on a hinge point on the supporting frame 41, i.e., on a position fixing pin P1. When the moving unit 70 pivots downward on the position fixing pin P1, the moving unit 70 pushes the ink cartridge 50 from the temporary mounting position in the receptacle 43 to a final mounting position, compressing the latching unit 60. Under the recovery force of the latching unit 60, the joint portion is fixedly positioned in a bent state.

The moving lever 71 pivots on the position fixing pin P1 at a predetermined angle and has a position protrusion 71*a* to be in contact with the contact member 65 when the moving lever 71 pivots downwardly. The position protrusion 71*a* has reverse mountain-shape sloping surfaces corresponding to the guide recess 65*a* of the contact member 65.

The position protrusion 71*a* is disposed farther away from a position varying pin P2 (described later) than from the position fixing pin P1. That is, the position fixing pin P1 is disposed between the position protrusion 71*a* and the position varying pin P2 such that the position protrusion 71*a* is subjected to a strong force when the handle lever 73 and the moving lever 71 pivot. Thus, the position protrusion 71*a* easily compresses the latching unit 60.

Figure 6:
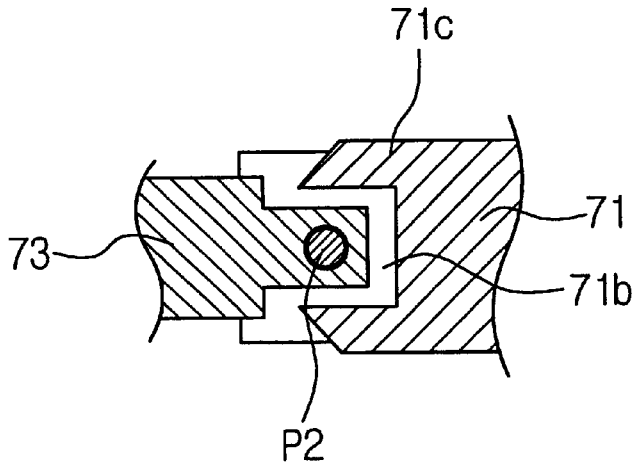
FIG. 6 is a sectional view showing parts of FIG. 5A.

The handle lever 73 is used as a working lever when a user mounts or removes the ink cartridge 50 and is pivotally connected to the moving lever 71 by the position varying pin P2. Also, the handle lever 73 pivots to a predetermined angle in relation to the moving lever 71. To achieve this, the moving lever 71 has a recess 71*b* of a predetermined depth formed at a portion corresponding to the position varying pin P2. In a state that a leading end of the handle lever 73 is inserted into the recess 71*b*, the handle lever 73 is connected to the moving lever 71 through the position varying pin P2. In the above construction, the recess 71*b* is defined within a jaw 71*c* (shown in FIG. 6) that restricts a pivoting angle at which the handle lever 73 pivots in relation to the moving lever 71.

Figure 7:
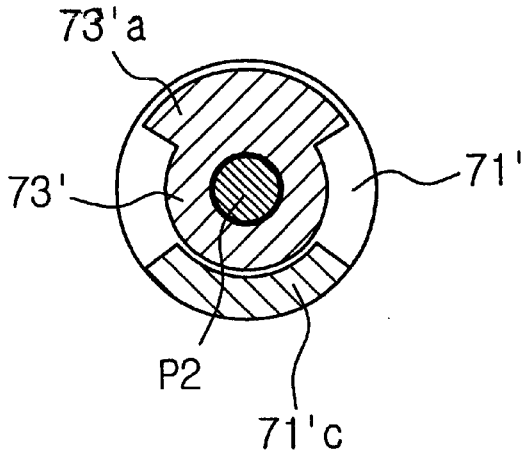
FIG. 7 is a sectional view showing a connecting part of a moving member and a handle lever according to another embodiment of the present invention.

According to another embodiment, as shown in FIG. 7, at respective portions where the moving lever 71' and the handle lever 73' are connected to each other by the position varying pin P2, jaws 71*c*' and 73*a*' are formed to restrict the angle of relative pivotal movements of the moving lever 71' and the handle lever 73'. According to this construction, when the handle lever 73' pivots in a predetermined direction, first, the handle lever 73' alone pivots freely at a predetermined angle. Then when the handle lever 73' contacts the respective jaws 71*c*' and 73*a*', the handle lever 73' pivots on the position varying pin P2 together with the moving lever 71'.

Accordingly, even if the handle lever 73 or 73' is suddenly pivoted by an excessive force, any possible shock is lessened due to the presence of the respective jaws 71*c* or 71*c*' and 73*a*'. Also, in the state in which the ink cartridge 50 is mounted, the respective jaws 71*c* or 71*c*' and 73*a*' are subjected to the recovery force as the lever spring 75 (described later) is compressed. Under the recovery force, a deformation of the handle lever 73 and moving lever 71 can be effectively prevented.

The lever spring 75 is disposed at the lower side of the handle lever 73 to elastically contact an upper portion of the ink cartridge 50 when the handle lever 73 pivots. The handle lever 73 may be a plate spring made of a metallic material or the lever spring 75 may be made of an engineering plastic material. Although not illustrated, the lever spring 75 may also be a coil spring.

We will now describe the operation of the above-described apparatus.

Figure 8:
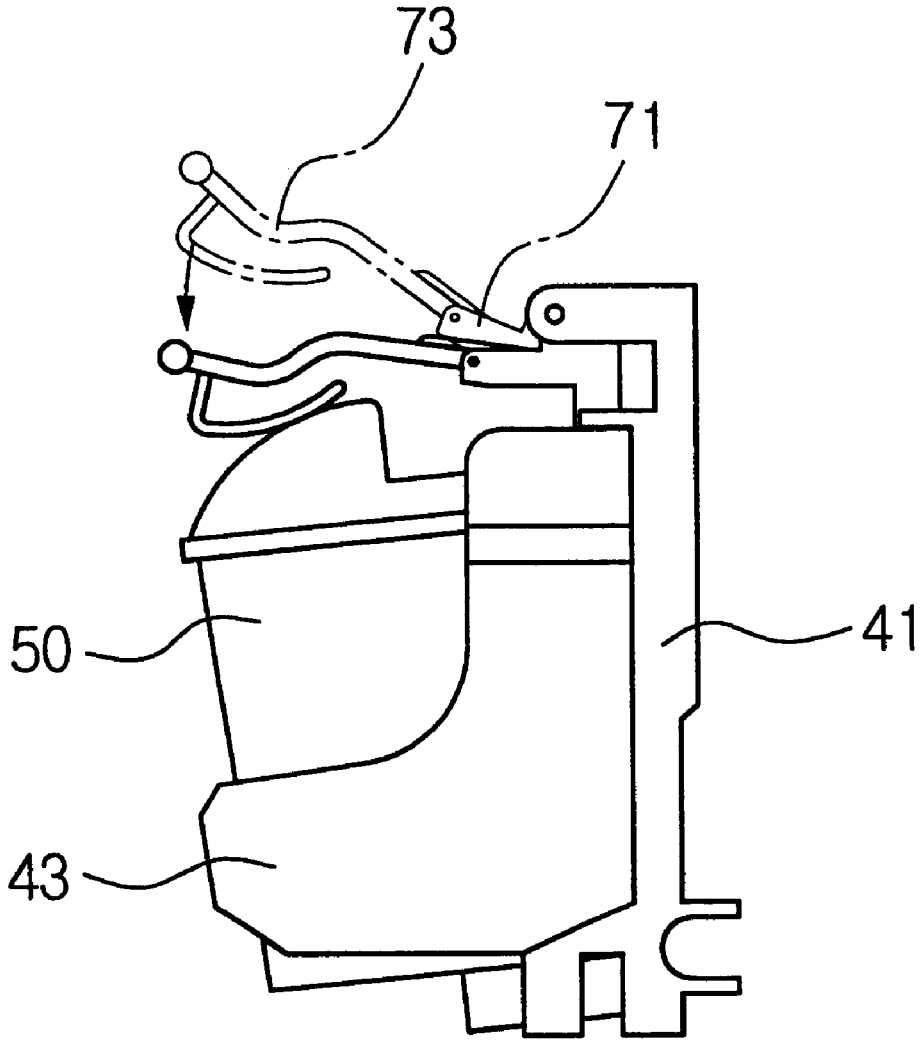
FIG. 8 is a side view showing a state in which an ink cartridge is mounted in a receptacle according to the present invention.

First, as shown in FIG. 8, the ink cartridge 50 is temporarily mounted in the receptacle 43 in a state in which the moving lever 71 and the handle lever 73 are both raised (as indicated by the dashed lines). Then, the ink cartridge 50 is put into a position inclining at a predetermined angle without being in close contact with the supporting frame 41. At this time, when the handle lever 73 is moved downward, the handle lever 73 pivots at a predetermined angle in relation to the moving lever 71. Then, when the leading end of the handle lever 73 contacts an inner wall of the recess 71*b*, i.e., with the jaw 71*c*, the handle lever 73 pivots together with the moving lever 71. At this time, as shown in FIG. 5A, the lever spring 75 pushes elastically on an upper portion of the ink cartridge 50 and thus the ink cartridge 50 makes close contact with the supporting frame 41. While the ink cartridge 50 is pushed into the close contact with the supporting frame 41, the sloping surface of the latching protrusion 51 slides over the sloping surface 63*a* of the latch member 63. That is, the latching protrusion 51 raises the latch member 63 slightly and moves inwardly. At the same time, the position protrusion 71*a* disposed at the lower end of the moving lever 71 pushes the contact member 65 downward to compress the spring 61. Then, the ink cartridge 50 closely contacts the supporting frame 41 and the latch member 63 is subjected to pressure due to the force of the spring 61 in the state in which the latching protrusion 51 is disposed inwardly from the latch member 63 such that the latching protrusion 51 is restrained from movement. Accordingly, unless the latching protrusion 51 is subjected to the force sufficient to overcome the recovery force of the spring 61, the latching protrusion 51 is not removed from the latch member 63.

Also, the recovery force of the spring 61 provides the contact member 65 with an upward pressure which is transmitted to the moving lever 71 to maintain the joint portion between the moving lever 71 and the handle lever 73 in the bent state. Since the joint portion between the handle lever 73 and the moving lever 71 is maintained to be bent due to the pressure of the spring 61, the handle lever 73 and the moving lever 71 cannot be easily moved unless a user lifts up the handle lever 73 with an external force. By simply moving the handle lever 73 downward, which is different from the conventional method, the ink cartridge 50 can be easily mounted in the receptacle 43 due to the lever action. Also, if the ink cartridge 50 is mounted, since the position protrusion 71*a* of the moving lever 71 fits in the guide recess 65*a* of the contact member 65 and the ink cartridge 50 is pressed, the accuracy of the mounting position of the ink cartridge 50 and reliability of the mounted state thereof can be increased.

Meanwhile, in order to remove the ink cartridge 50 from the receptacle 43, the handle lever 73 pivots in reverse order to the order by which the ink cartridge 50 is mounted in the receptacle 43. That is, the handle lever 73 is raised as shown in FIG. 5A to the position indicated by the dashed line. Then, the lever spring 75 is released from contact with the ink cartridge 50 and the handle lever 73 pivots together with the moving lever 71. Accordingly, the position protrusion 71*a* is released from contact with the contact member 65 and the spring 61 is de-compressed such that the latching protrusion 51 is released from the force of the spring 61 that is generated due to the compression of the spring 61. When the latching protrusion 51 and the latch member 63 are released from the pressure therebetween, the user seizes the ink cartridge 50 and pulls the ink cartridge 50 from the supporting frame 41. Then the latching protrusion 51 raises the latch member 63 slightly and is removed outwardly from the latching connection such that the ink cartridge 50 is again put into the position inclining at a predetermined angle, as shown in FIG. 8. Finally, by removing the ink cartridge 50 from the receptacle 43, the operation to remove the ink cartridge 50 is completed. Next, a new ink cartridge 50 is mounted in the receptacle 43 in the ink cartridge mounting order as described above and then the ink cartridge replacement is repeated.

In the embodiments of the present invention described above, a printer employing more than two ink cartridges which are replaced one by one is exemplified. However, it is understood that the present invention should not be limited to this example but a construction to replace two or more ink cartridges simultaneously can also be made.

According to the apparatus to remove the ink cartridge 50 of the ink-jet printer as described above, the apparatus comprises a moving unit 70 to latch and unlatch the latching unit 60 so that the ink cartridge 50 can be easily removed.

Also, when mounting the ink cartridge 50, since the handling point is determined by the latching unit 60, the user is not required to put his/her hand in the apparatus to check the handling point. Thus, there is an additional advantage that damage to the parts can be prevented and the stability thereof can be increased. Also, the present invention can be applied regardless of a configuration of the ink cartridge.

Since there is less friction between the latching protrusion 51 and the latch member 63 than in the conventional design, there is almost no abrasion generated therebetween. Accordingly, even if the apparatus is used several times, the contact force between the ink cartridge 50 and the supporting frame 41 is not decreased. Also, since the dimple 25*a* is subjected to less pressure than in the conventional design, there is no contact deficiency between the dimple 25*a* and the ink cartridge head 13, and thus the reliability of the product is improved.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An apparatus to remove ink of an ink-jet printer, the apparatus comprising:

a carriage having:

a supporting frame movably supported by a guide rail, and a receptacle connected to the supporting frame;

an ink cartridge removable from the receptacle, the ink cartridge having a latching protrusion formed at an upper end thereof;

a latching unit disposed at the supporting frame, being compressible and de-compressible, the latching unit latched to the latching protrusion in a compressed state and being released from the latching protrusion in a de-compressed state; and a moving unit having a joint portion to pivot a predetermined angle, the moving unit pivotally disposed at the supporting frame, to pivot in a first direction to mount the ink cartridge from a temporary mounting position in the receptacle and to compress the latching unit, the joint portion being fixedly positioned in a bent state due to a recovery force of the latching unit in the compressed state, and the moving unit to pivot in a second direction, opposite the first direction, to permit the latching unit to return to the decompressed form.

2. The apparatus of claim 1, wherein the latching unit comprises:

a spring;

a latch member connected to a first end of the spring, the latch member having a sloping side corresponding to the latching protrusion; and a contact member connected to a second end of the spring, opposite the first end of the spring, the contact member having a guide recess formed at an upper end thereof to guide the contact member to contact the moving unit.

3. The apparatus of claim 1, wherein the moving unit comprises:

a moving lever, a first end thereof being pivotally disposed at the supporting frame, the moving lever to pivot and thereby compress the latching unit;

a handle lever disposed at a second end of the moving lever, opposite the first end of the moving lever, and to pivot the predetermined angle, the handle lever to pivot on the moving lever and to pivot together with the moving lever; and a lever spring disposed at a lower end of the handle lever, the lever spring to press the upper end of the ink cartridge from the temporary mounting position in the receptacle to contact the supporting frame during the pivoting movement of the handle lever.

4. The apparatus of claim 3, wherein at least one of respective hinge connecting portions of the moving lever and the handle lever defines a jaw to restrict an angle of relative pivotal movement between the moving lever and the handle lever.

5. The apparatus of claim 3, wherein the lever spring comprises a plate spring made of a metallic material.

6. The apparatus of claim 3, wherein the lever spring comprises an engineering plastic material.

7. The apparatus of claim 3, wherein the lever spring comprises a coil spring.

8. The apparatus of claim 3, wherein the moving lever comprises a jaw to restrict an angle of relative pivotal movement between the moving lever and the handle lever, and the jaw defines a recess to receive the handle lever.

9. The apparatus of claim 3, wherein the handle lever and the moving lever each comprise a jaw protruding radially therefrom, the jaws to restrict an angle of relative pivotal movement between the moving lever and the handle lever.

10. The apparatus of claim 3, wherein the handle lever moves relative to the moving lever in the first portion of the pivoting movements of the handle and moving levers, and the handle and moving levers pivot in unison in a second portion of the pivoting movements of the handle and moving levers.

11. The apparatus of claim 10, wherein the pivoting movements of the handle and moving levers compress the latching unit to thereby mount the ink cartridge.

12. The apparatus of claim 10, wherein the pivoting movements of the handle and moving levers decompress the latching unit to thereby demount the ink cartridge.

13. The apparatus of claim 1, further comprising a position protrusion formed at the moving unit to contact the latching unit during the pivoting of the moving unit, the position protrusion being disposed farther away from the joint portion than a hinge point on the supporting frame of the moving unit.

14. The apparatus of claim 13, further comprising a plurality of ink cartridges to be removed from the ink-jet printer.

15. A system, comprising:

an ink cartridge; and a printer to receive the ink cartridge, comprising:

a compressible/decompressible latching unit to receive the ink cartridge and thereby mount the ink cartridge to the printer, and a moving unit to compress/decompress the latching unit to mount/demount the ink cartridge to/from the printer.

16. The system of claim 15, wherein:

the ink cartridge comprises a latching protrusion, and the latching unit is latched to the latching protrusion in a compressed state of the latching unit, and is released from the latching protrusion in a de-compressed state of the latching unit.

17. The apparatus of claim 16, wherein the latching unit comprises:

a spring;

a latch member connected to a first end of the spring, the latch member having a sloping side corresponding to the latching protrusion; and a contact member connected to a second end of the spring, opposite the first end of the spring, the contact member having a guide recess to guide the contact member to contact the moving unit.

18. The apparatus of claim 17, wherein the latch member comprises reverse mountain-shape sloping surfaces.

19. A printer to receive an ink cartridge having a latching protrusion, the printer comprising:

a compressible/decompressible latching unit to receive the latching protrusion and thereby mount the ink cartridge to the printer, and a moving unit to compress/decompress the latching unit to mount/demount the ink cartridge to/from the printer.

20. The printer of claim 19, wherein the latching unit is latched to the latching protrusion in a compressed state of the latching unit, and is released from the latching protrusion in a de-compressed state of the latching unit.

21. The printer of claim 20, wherein the latching unit comprises:

a spring;

a latch member connected to a first end of the spring, the latch member having a sloping side corresponding to the latching protrusion; and a contact member connected to a second end of the spring, opposite the first end of the spring, the contact member having a guide recess to guide the contact member to contact the moving unit.

22. A method of mounting/demounting an ink cartridge having a latching protrusion to/from a printer having a compressible/decompressible latching unit to receive the latching protrusion, comprising:

moving a moving unit of the printer in a first direction to decompress the latching unit;

inserting the ink cartridge into the latching unit; and moving the moving unit in a second direction, opposite to the first direction, to compress the latching unit and thereby mount the ink cartridge.

23. The method of claim 22, further comprising:

moving the moving unit in the first direction to demount the ink cartridge.

* * * * *